US006149707A

United States Patent [19]

Jamaluddin

[11] Patent Number: 6,149,707

[45] Date of Patent: Nov. 21, 2000

[54] METHOD FOR PYROCLEANING METAL COMPONENTS

[76] Inventor: Aziz A. Jamaluddin, P.O. Box 7060, The Woodlands, Tex. 77387

[21] Appl. No.: 09/470,060

[22] Filed: Dec. 22, 1999

Related U.S. Application Data

[62] Division of application No. 09/162,344, Sep. 28, 1998.

[51] Int. Cl.[7] ..... C22B 1/00

[52] U.S. Cl. ..... 75/403; 134/19; 134/40

[58] Field of Search ..... 432/14, 17, 2, 432/59, 72, 75; 110/236; 126/21 R, 299 R; 219/400; 134/40, 19, 42, 34, 37; 75/403

[56] References Cited

U.S. PATENT DOCUMENTS

| | | | |
|---|---|---|---|
| 3,627,289 | 12/1971 | Erman | 134/19 |
| 4,032,361 | 6/1977 | Eriksson et al. | 75/403 |
| 4,141,373 | 2/1979 | Kartanson et al. | 75/403 |
| 4,548,651 | 10/1985 | Ramsey | 75/385 |
| 5,338,335 | 8/1994 | Saxena | 75/403 |

*Primary Examiner*—Pamela Wilson
*Assistant Examiner*—Jiping Lu
*Attorney, Agent, or Firm*—Keeling Law Firm

[57] ABSTRACT

This is a method for pyrocleaning that degreases metal components using an oven, an oxidizer, a system gas supply, a system gas exhaust, and heat exchangers. The degreasing is accomplished by first transporting the metal components through the oven and exposing the oil coated metal components to hot gases which have a temperature above the vaporization point of the oil. The hot gases are introduced into the oven by way of the system gas supply that does not include products of combustion (indirect heating). Since the gases are at a temperature above the vaporization point of the oil, upon contact with the metal components, the gases cause the oil to evaporate from the metal components. The resultant hydrocarbon-filled surrounding gases are then evacuated from the oven and transported to the oxidizer. In the oxidizer, the hydrocarbon-filled gases are exposed to a burner that catalyzes the oxidation process. After exiting from the oxidizer, the hydrocarbon-free gases are discharged into the atmosphere. The oven also includes at least one low and at least one high pressure gas supply injectors which together serve as the heating source for the oven. The high pressure gas supply injector also acts to increase the evaporation rate of the oil, and thereby decrease the resident heating time of the metal components. A second heat exchanger, in addition to a first heat exchanger, provides efficiency to the system.

10 Claims, 6 Drawing Sheets

METHOD FOR PYROCLEANING METAL COMPONENTS

This application is a division of Ser. No. 09/162,344 filed Sep. 28, 1998.

BACKGROUND OF THE INVENTION

1. Field of Invention

This invention relates generally to the removal of oil and grease from metal components hereinafter referred to as degreasing). Specifically, this invention is an efficient and novel degreasing system which, in sequence, pyrolizes the oil and grease from metal components by indirect heating, combusts the environmentally harmful hydrocarbon-filled evaporated gases which are produced in the pyrolysis operation, and discharges the environmentally safe hydrocarbon-less gases which result from the combustion process.

The degreasing of metal components is necessary for a variety of operations and for a number of different components. For instance, automobile air conditioner evaporator fins are typically coated with a lubricating oil during their fabrication or formation. Subsequent to their formation, the fins must also be brazed. However, prior to the brazing step, the fins must be very clean and all lubricating oil must therefore be removed from the fins. Metal components must also be degreased during the metal reclamation process wherein all metal contaminants are removed from the components prior to melting of the metal.

2. Related Art

One method which is used to degrease metal components is aqueous cleaning, in which an already heated metal component is dipped in a chemically reactive solvent, such as trichloroethylene. The pre-heating and the chemical reaction which results with the solvent raise the temperature of the metal component to a temperature that is higher than both the vapor point of the oil and the vapor point of the solvent. Thus, when the metal component is removed from the solvent bath, all oil and solvent thereon evaporates leaving a solvent-less and oil-less metal component. Illustrative of such aqueous cleaning is U.S. Pat. No. 2,104,102 issued to Ruthven. Aqueous cleaning, however, requires the additional expense of the solvent, and, depending on the solvent and solvent-induced by-products, may also be environmentally hazardous.

Other degreasing methods which raise the temperature of metal components above the oil vapor point do so without regulating or limiting the heating temperature. Illustrative of such methods are U.S. Pat. No. 2,856,333 issued to Topelian and U.S. Pat. No. 4,684,411 issued to Johnson et al. An excessively high heating temperature, however, produces a thickening of the protective oxide layer of the component, particularly in components that are aluminum based. The thickening of the oxide layer is unacceptable for those components which must be subsequently brazed, such as automobile air conditioner fins.

In addition, many degreasing methods heat the metal components without maintaining a homogenous heating temperature. A non-homogenous heating temperature is particularly problematic in methods which utilize a furnace, oven, or rotary kiln to heat the components. Non-homogenous heating of the metal components may in turn result in incomplete evaporation of the oil from the metal components. U.S. Pat. No. 4,548,651 issued to Ramsey shows the use of a rotary kiln.

Pyrolysis is another degreasing method wherein the metal components are exposed to gases or air having a temperature higher than the vapor point of the oil. In pyrolysis, the metal components can either be directly or indirectly heated. Direct heating occurs if the metal components are exposed to gases or air which were heated by direct combustion and thus include the products of combustion while surrounding the components. Illustrative of such direct heating are U.S. Pat. No. 3,627,289 issued to Erman and U.S. Pat. No. 4,201,370 issued to Evans et al. Indirect heating, on the other hand, occurs if the metal components are exposed to gases or air which do not include the products of combustion. The use of direct heating results in the production of water vapor as the oil is evaporated from the metal components thereby creating a likelihood for condensate to form not only inside of the heating system, but also on the metal components. Such condensate formation is highly disfavored, particularly for components that must be subsequently brazed.

Also of concern in degreasing operations is the generation of environmentally harmful by-products. For example, the pyrolysis operation generates environmentally harmful hydrocarbon-filled gases. These environmentally harmful by-products must somehow be safely disposed or treated prior to disposal.

Necessarily, residence heating time is also an important parameter of degreasing operations. The residence heating time for any given degreasing operation must be long enough to ensure that all oil has been removed from the metal component, but must be short enough to make the operation and the turnover of metal components efficient. A shorter residence heating time is always preferred provided that the components are adequately cleaned.

U.S. Pat. No. 5,016,809 issued to Winterbottom et al. teaches a process to degrease aluminum based sheets essentially comprising the heating of the sheets in a reactive atmosphere at a temperature between 300 and 400° C. for about 10 minutes to about 30 minutes thereby evaporating the oil and grease from the sheets without concurrently thickening the oxide layer of the sheets. However, the Winterbottom Patent does not address the benefits of and needs for a homogenous heating temperature and a reduction of residence heating time, as addressed herein. Furthermore, although it teaches a pyrolysis operation, the Winterbottom Patent does not address the considerable and important distinction between utilizing indirect versus direct heating. Finally, the Winterbottom Patent does not discuss an adequate and environmentally safe disposal of the hydrocarbon-filled gases which are generated by the pyrolysis operation.

SUMMARY OF THE INVENTION

Accordingly, the objectives of this invention are to provide, inter alia, a new and improved system and method for degreasing metal components that:

- does not utilize costly or environmentally hazardous solvents;
- does not utilize exceedingly high heating temperatures;
- does not cause the thickening of the components' oxide layer;
- utilizes a homogenous heating temperature;
- includes a pyrolysis procedure that uses indirect heating;
- includes a means by which to safely treat or dispose of the hydrocarbon-filled gas by-products of pyrolysis;
- decreases residence heating time, given a constant heating gas temperature and oil coating, thereby saving time and energy; and
- includes a pyrolysis procedure which is economically and energy efficient.

Other objects of the invention will become apparent from time to time throughout the specification hereinafter disclosed.

To achieve such improvements, my invention is a Pyrocleaning Furnace and Thermal Oxidizer System which degreases metal components that comprises an oven, an oxidizer, a system gas supply means, a system gas exhaust means, and a first heat exchanger. The degreasing is accomplished by first transporting the metal components through the oven and exposing the oil coated metal components to hot gases which have a temperature above the vaporization point of the oil, but not one that is exceedingly high thereby also preventing the thickening of the oxide layer of the metal components. The hot gases are introduced into oven by way of the system gas supply means and do not include products of combustion (indirect heating). Since the gases are at a temperature above the vaporization point of the oil, upon contact with the metal components, the gases cause the oil to evaporate from the metal components. The resultant hydrocarbon-filled surrounding gases are then quickly evacuated from the oven and transported to the oxidizer. In the oxidizer, the hydrocarbon-filled gases are exposed to a burner which catalyzes the oxidation process. Thus, the hydrocarbons in the gases are burned and chemically altered resulting in an output gas which includes minimal hydrocarbons or other environmentally harmful gases. After exiting from the oxidizer, the hydrocarbon-less gases are safely discharged into the atmosphere by way of the system gas exhaust means. The oven also includes at least one low and at least one high pressure gas supply means which together serve as the heating source for the oven. The high pressure gas supply means also acts to increase the evaporation rate of the oil, and thereby decrease the resident heating time of the metal components, by impinging and creating a fluttering action on the metal components. A second heat exchanger, in addition to the first heat exchanger, provides efficiency to the system.

DETAILED DESCRIPTION OF THE INVENTION

Figure 1:
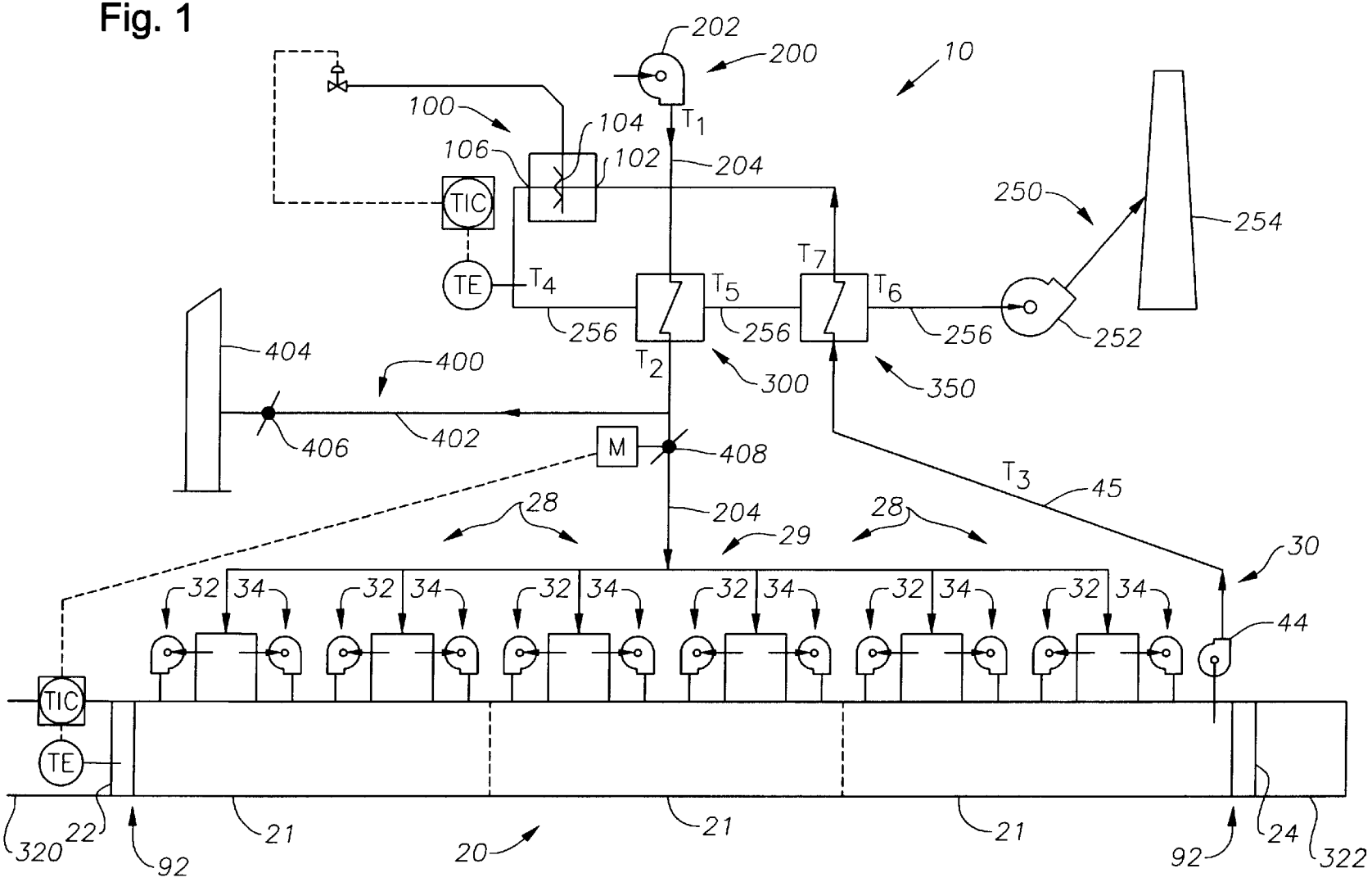
FIG. 1 is a schematic diagram of the system.
Figure 2:
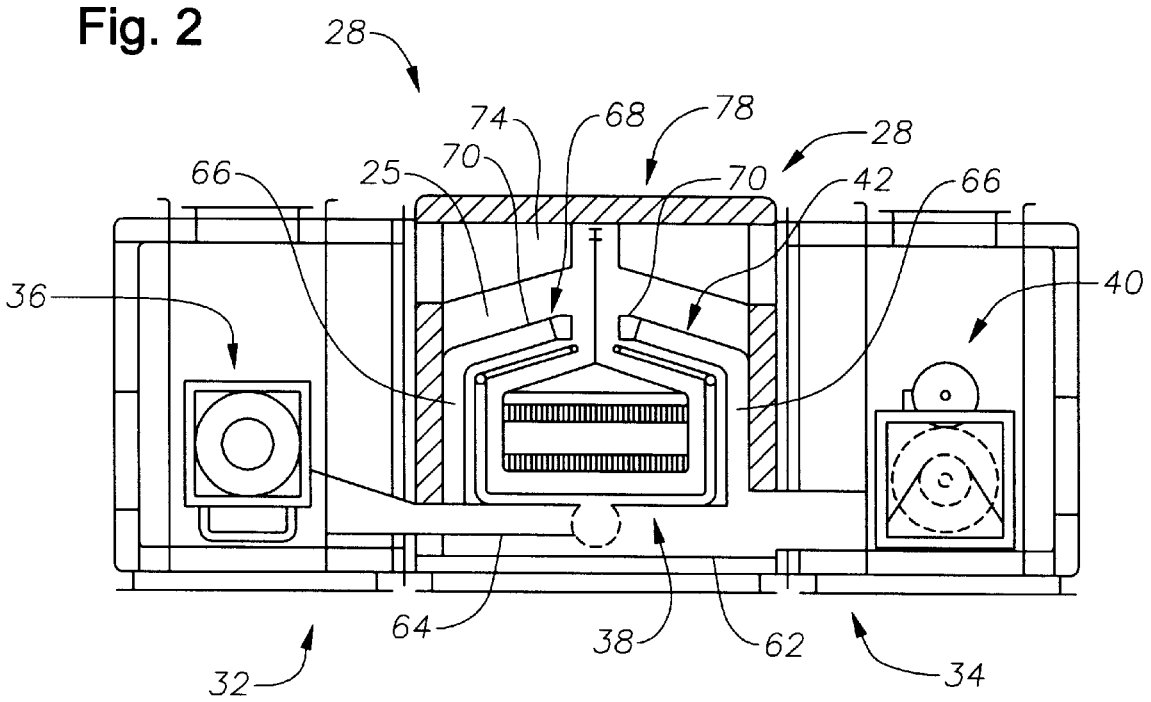
FIG. 2 is a front cross-sectional view of the oven.
Figure 3:
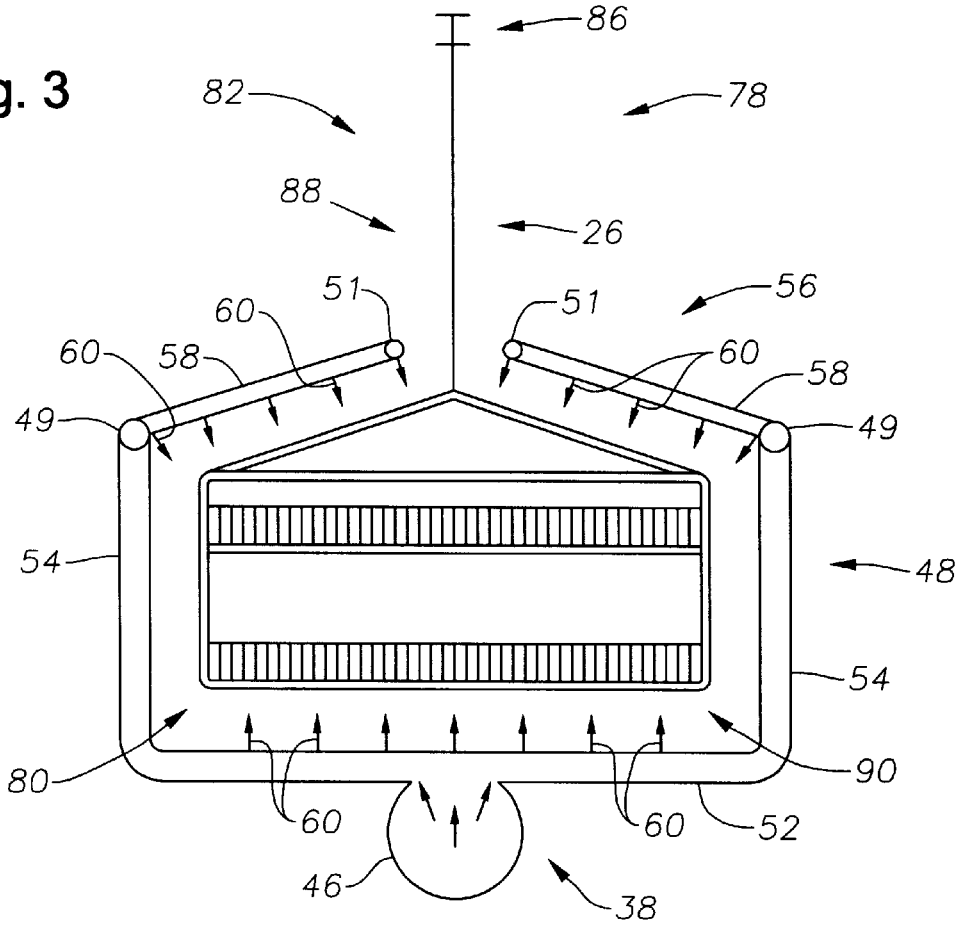
FIG. 3 is a cross-sectional view of the high pressure gas supply conduit framing one carrier mechanism therein.
Figure 4:
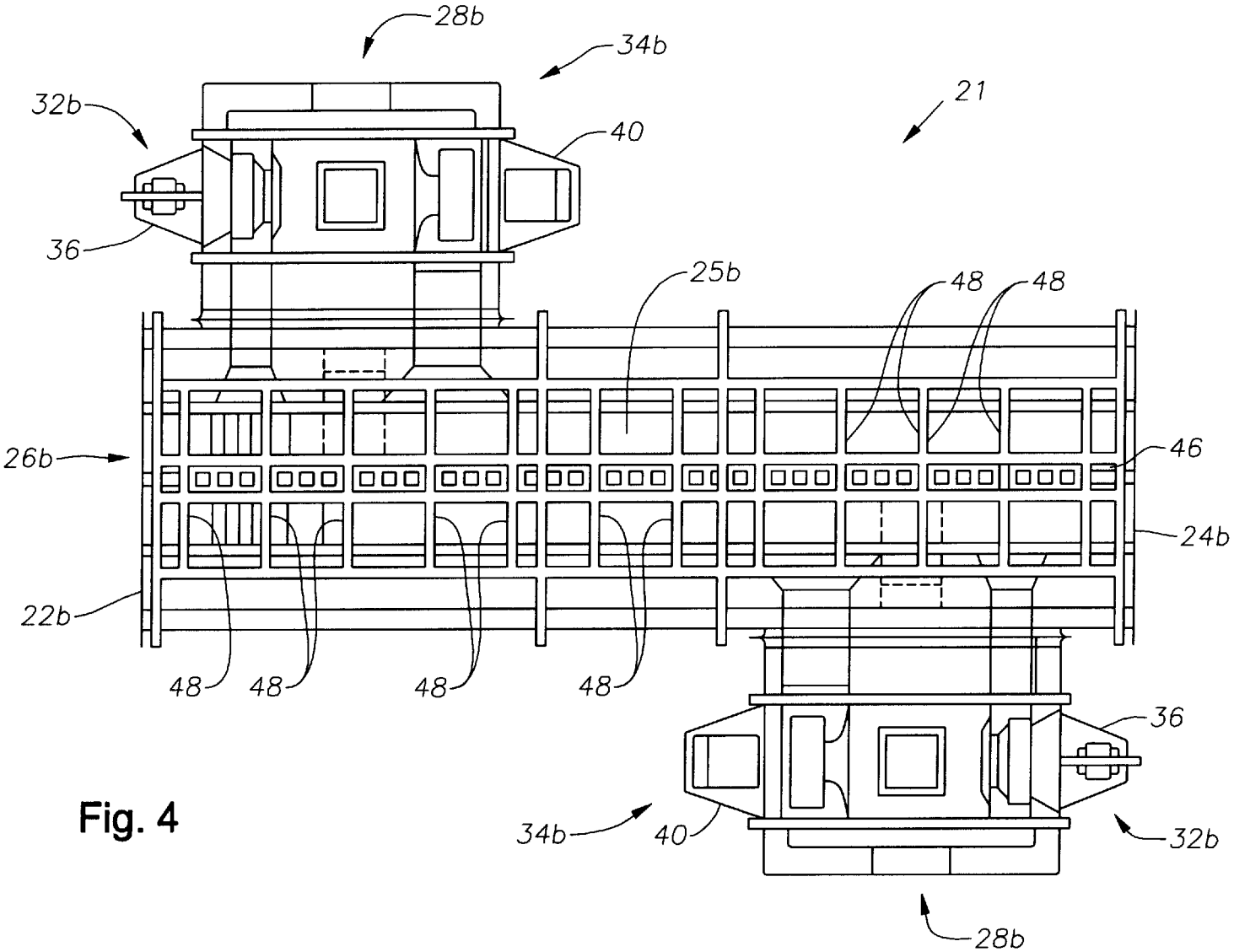
FIG. 4 is a plan cross-sectional view of an oven section.
Figure 5:
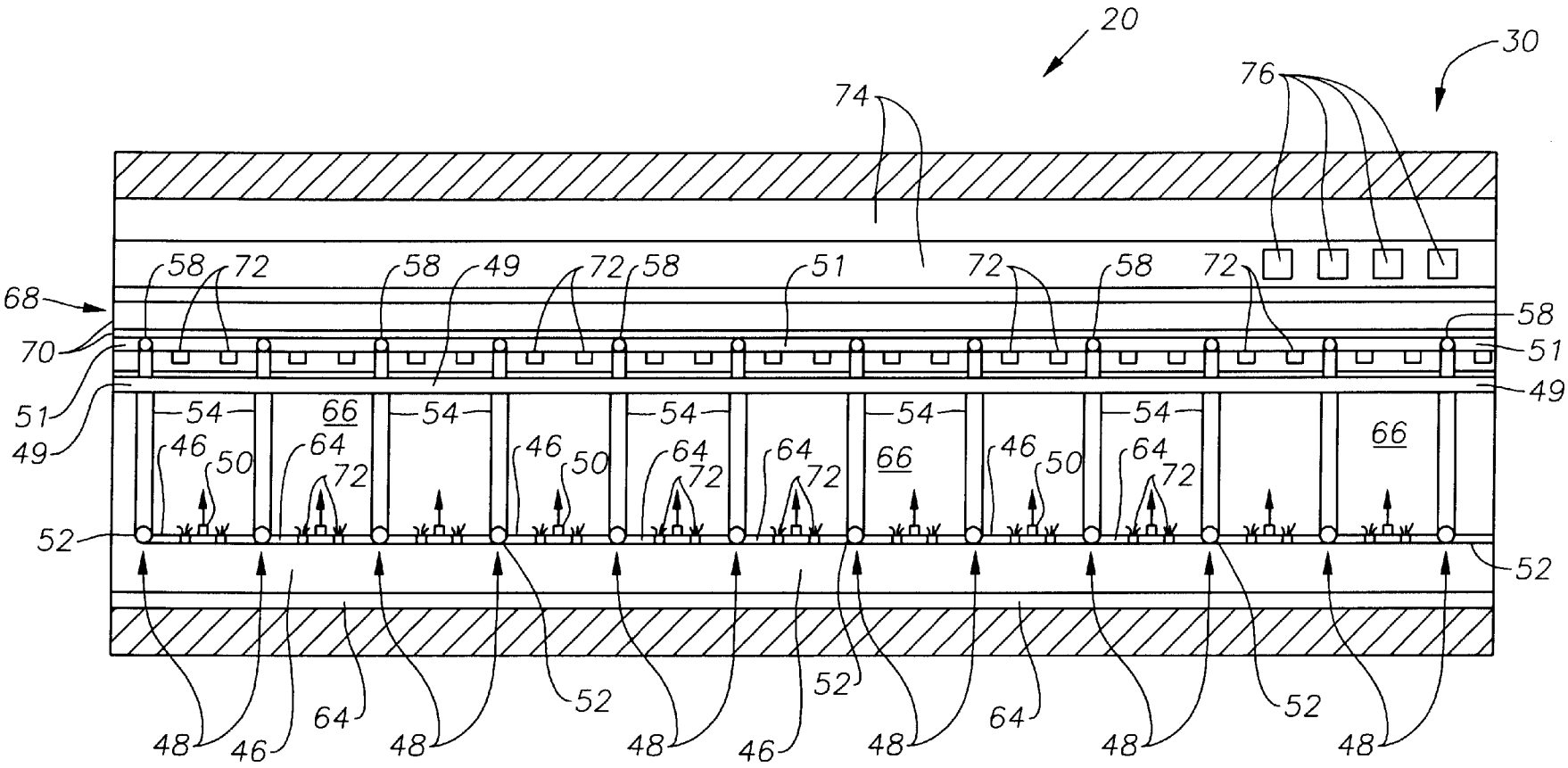
FIG. 5 is a side cross-sectional view of an oven section.
Figure 7:
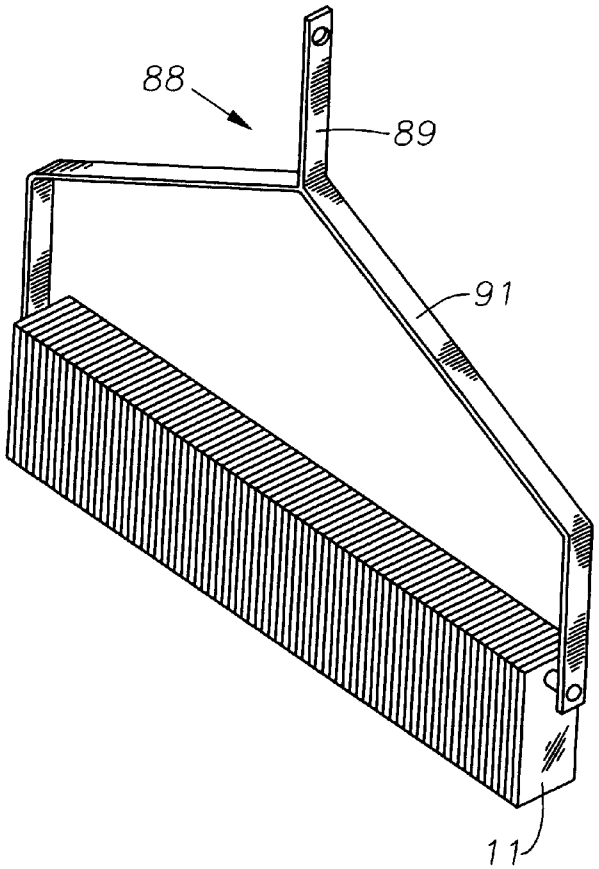
FIG. 7 is an isometric view of the evaporator find positioned within a second embodiment of the carrier mechanism.

The Pyrocleaning Furnace and Thermal Oxidizer System is shown generally in FIGS. 1–9 as reference numeral 10. System 10 generally comprises an oven 20, an oxidizer 100, a system gas supply means 200, a system gas exhaust means 250, and a first heat exchanger 300. System 10 is generally utilized to degrease, that is to remove oil and grease, from metal components 11. In particular, system 10 may be used to efficiently degrease automobile air conditioning evaporator fins subsequent to their formation but prior to their brazing step. It is understood however that system 10 may be utilized to remove a variety of contaminants from a variety of metal components 11.

The degreasing is accomplished by first transporting the metal components 11 through the oven 20 and exposing the oil coated metal components 11 to hot gases having a temperature between the vaporization point of the oil and the melting point of the metal components 11. The hot gases are introduced into oven 20 by way of the system gas supply means 200 and do not include products of combustion (indirect heating). Since the gases are at a temperature above the vaporization point of the oil, upon contact with the metal components 11, the gases cause the oil to evaporate from the metal components 11. The resultant hydrocarbon-filled surrounding gases are then quickly evacuated from the oven 20 and transported to the oxidizer 100. In the oxidizer 100, the hydrocarbon-filled gases are exposed to a burner which catalyzes the oxidation process. Thus, the hydrocarbons in the gases are burned and chemically altered resulting in output gases which include minimal hydrocarbons or other environmentally harmful gases. After exiting from the oxidizer 100, the hydrocarbon-less gases are safely discharged into the atmosphere by way of the system gas exhaust means 250.

Oven 20 includes an oven entry 22 on one end, an oven exit 24 at its other end, and an oven interior therein 25. A transportation mechanism 26 transports the metal components 11 within the oven interior 25 from oven entry 22 to oven exit 24. Oven 20 may be of any practical shape provided that the oven interior 25 defines an elongated corridor which allows transportation mechanism 26 to pass therethrough. Thus, oven 20 may include straight portions as well as curved portions. Oven gas supply means 28 provides fluid communication between the oven interior 25 and system gas supply means 200. Oven gas supply means 28 therefore provides and enables gas flow into the oven interior 25. Oven 20 further includes an oven gas exhaust means 30 which evacuates the gas from within the oven interior 25.

In the preferred embodiment, oven 20 also includes oven seals 92 at both the oven entry 22 and the oven exit 24 which act to seal the oven interior 25 from the outside atmosphere. Preferably, the oven seals 92 comprise air seals, such air seals being well-known in the art.

In the preferred embodiment, oven gas supply means 28 comprises at least one high pressure gas supply means 32 and at least one low pressure gas supply means 34. Relative to each other, high pressure gas supply means 32 discharges gas at a higher pressure than low pressure gas supply means 34. Each high pressure gas supply means 32 includes at least one variable frequency drive high pressure gas supply fan 36 and at least one high pressure gas supply conduit 38. Similarly, each low pressure gas supply means 34 includes at least one variable frequency drive low pressure gas supply fan 40 and at least one low pressure gas supply conduit 42. Oven gas exhaust means 30 comprises an gas exhaust blower 44 and at least one gas exhaust conduit 74.

In general, each of the high pressure gas supply conduits 38 and each of the low pressure gas supply conduits 42 direct gas towards the metal components 11 positioned within the transportation mechanism 26, as the transportation mechanism 26 carries the metal components 11 through oven 20. In the preferred embodiment, the high pressure gas supply conduits 38 carry approximately 40% while the low pressure gas supply conduits 42 carry approximately 60% of the total gas volume flowing into oven interior 25. Preferably, within the oven interior 25, the high pressure gas supply conduits 38 are located interior to the low pressure gas supply conduits 42. Also preferably, the high pressure gas supply conduits 38 and the low pressure gas supply conduits 42 direct gas towards the metal components 11 from the top and bottom of the transportation mechanism 26.

In the preferred embodiment, each high pressure gas supply conduit 38 comprises a high pressure duct 46. High pressure duct 46, which is in fluid communication with the high pressure gas supply fan 36, runs lengthwise within the oven interior 25 directly underneath the transportation mechanism 26. In addition, high pressure duct 46 runs at least partially from the oven entry 22 to the oven exit 24. Proximate the transportation mechanism 26, high pressure duct 46 includes a plurality of ports 50 which provide fluid communication between the interior and exterior of high pressure duct 46. Preferably, the plurality of ports 50 are equally spaced apart along the length of high pressure duct 46 and are constructed so that each directs gas from within the high pressure duct 46 to the bottom of the transportation mechanism 26.

Each high pressure gas supply conduit 38 also preferably comprises a plurality of plenums 48. Preferably, the plurality of plenums 48 are equally spaced apart along the length of high pressure duct 46. Each plenum 48 frames the transportation mechanism 26 (as the transportation mechanism 26 travels therethrough) and comprises a bottom portion 52, two vertical portions 54, and a top portion 56, each of which is hollow. Bottom portion 52 is connected to and is in fluid communication with high pressure duct 46. Preferably, bottom portion 52 is positioned transversely to high pressure duct 46. A vertical portion 54 is connected to and is in fluid communication with each lateral end of the bottom portion 52. The top portion 56 is connected to and is in fluid communication with the top end of each vertical portion 54. In the preferred embodiment, top portion 56 comprises two top portion sections 58. In this embodiment, one of the top portion sections 58 is connected to and is in fluid communication with the top ends of each of the vertical portions 54. The top portion sections 58 extend toward each other but do not meet providing a space therebetween. Preferably, the top portion sections 58 also extend upwards towards each other at a 45° angle from horizontal.

Proximate the transportation mechanism 26, bottom portion 52 and top portion 56 (or top portion sections 58 in the relevant embodiment) include a plurality of passages 60 which provide fluid communication between the interior and exterior of plenum 48. Preferably, the plurality of passages 60 are equally spaced apart along the bottom portion 52 and are constructed so that each directs gas from within the plenum 48 to the bottom of the transportation mechanism 26. Preferably, the plurality of passages 60 are equally spaced apart along the top portion 56 (or top portion sections 58 in the relevant embodiment) and are constructed so that each directs gas from within the plenum 48 to the top of the transportation mechanism 26. In the preferred embodiment of the high pressure gas supply means 32, the high pressure gas supply fans 36 and conduits 38 are rated and constructed so that the arrival velocity of the high pressure gas as it passes through the plurality of ports 50 and the plurality of passages 60 into the oven interior 25 is in the range of 5000–7000 ft/min.

In the preferred embodiment, the plurality of plenums 48 are connected to and in fluid communication with each other by two longitudinal first pipes 49 and by two longitudinal second pipes 51. One longitudinal first pipe 49 is connected at the junction between each plenum vertical portion 54 and its associated top portion 56 (or top portion section 58 in the relevant embodiment) and is also in fluid communication with such portions. One longitudinal second pipe 51 is connected to the free end of each top portion section 58 and is also in fluid communication with such portion. In one embodiment (not shown), each longitudinal first and second pipe, 49 and 51, also include a plurality of passages 60 constructed to direct gas to the top of the transportation mechanism 26.

In the preferred embodiment, each low pressure gas supply conduit 42 comprises a low pressure duct 62 which frames not only the transportation mechanism 26 (as the transportation mechanism 26 therethrough) but also the plurality of plenums 48. Preferably, low pressure duct 62 includes a bottom segment 64, a plurality of sets of two vertical segments 66, and a top segment 68. Bottom segment 64 is in fluid communication with the low pressure gas supply fan 40 and runs lengthwise within oven interior 25 at least partially from the oven entry 22 to the oven exit 24. The plurality of sets of vertical segments 66 are preferably equally spaced along the length of the bottom segment 64. Each vertical segment 66 is connected to and in fluid communication with the bottom segment 64. The two vertical segments 66 of each set are laterally opposed to each other (at the sides of oven interior 25) in relation to the bottom segment 64. The top segment 68 is connected to and is in fluid communication with the top end of each vertical segment 66. In the preferred embodiment, top segment 68 comprises two top segment sections 70. In this embodiment, one of the top segment sections 70 is connected to and is in fluid communication with the top ends of each of the vertical segments 66. The top segment sections 70 extend toward each other but do not meet providing a space therebetween. Preferably, the top segment sections 70 extend upwards towards each other at a 45° angle from horizontal.

Proximate the transportation mechanism 26, bottom segment 64 and top segment 68 (or top segment sections 70 in the relevant embodiment) include a plurality of openings 72 which provide fluid communication between the interior and exterior of low pressure duct 62. Preferably, the plurality of openings 72 are equally spaced apart along the low pressure duct 62 and are constructed so that they direct gas from within the low pressure duct 62 to the top and bottom of transportation mechanism 26. In the preferred embodiment of the low pressure gas supply means 34, the low pressure gas supply fans 40 and conduits 42 are rated and constructed so that the arrival velocity of the low pressure gas as it passes through the plurality of openings 72 into the oven interior 25 is in the range of 1500–3000 ft/min.

In the preferred embodiment, each gas exhaust conduit 74 is in fluid communication with the gas exhaust blower 44. Each gas exhaust conduit 74 also preferably runs lengthwise within the oven interior 25 from oven exit 24 partially to oven entry 22. In the preferred embodiment, each gas exhaust conduit 74 is located above the transportation mechanism 26 and preferably above each low pressure gas supply conduit 42 and each high pressure gas supply conduit 38. Proximate the oven interior 25, each gas exhaust conduit 74 includes at least one hole 76 which provides fluid communication between the interior and exterior of the gas exhaust conduit 74. Preferably, the at least one hole 76 comprises a plurality of holes 76 which are equally spaced apart along the length of gas exhaust conduit 74.

The oven interior 25 should be maintained at a slightly negative pressure to prevent environmentally hazardous hydrocarbon-filled gases from escaping the oven 20 through either the high pressure or low pressure gas supply conduits, 38 and 42. Thus, the gas exhaust blower 44 must be rated so that it evacuates gas from the oven interior 25 at a slightly higher volumetric rate than the rate at which the high pressure and low pressure gas supply fans, 36 and 40, introduce gas into oven interior 25. The results created by the slightly negative pressure within oven interior 25 comply with EPA and NFPA regulations.

The gas exhaust blower 44 and the high pressure and low pressure gas supply fans, 36 and 40, must also be rated so that the volumetric gas change within oven interior 25 is rapid, preferably between 15–50 volumetric gas changes per minute. The rapid volumetric gas changes within oven interior 25 ensure the quick capture and removal of the hydrocarbons which have evaporated from the metal components 11. In turn, the quick capture and removal of the evaporated hydrocarbons from the oven interior 25 minimizes the re-condensation of the oil/hydrocarbon vapors within oven interior 25. Because the purpose of the operation is to clean the metal components 11, the inhibition of condensate formation within oven interior 25 is highly desirable.

In the preferred embodiment, prior to oven entry 22, oven 20 includes an oven entry vestibule 320. Also in the preferred embodiment, oven 20 includes an oven exit vestibule 322 past the oven exit 24. In this embodiment, oven exit vestibule 322 includes a cool down section 324 which cools down the metal components 11 after they have traveled through oven 20. Cool down section 324 preferably comprises at least one cool air fan 326, preferably rated at approximately 4000 CFM, which blows ambient air directed to the metal components 11 at a high velocity in order to minimize the formation of condensation thereon.

As previously disclosed, the transportation mechanism 26 carries and transports the metal components 11 through the oven 20 from the oven entry 22 to the oven exit 24. The transportation mechanism 26 preferably comprises a conveyance mechanism 78 and a carrier mechanism 80. The metal components 11 are situated on the carrier mechanism 80 which is transported through the oven 20 by the conveyance mechanism 78. In the preferred embodiment, the transportation mechanism 26 extends from the oven entry 22 (or oven entry vestibule 320 in the relevant embodiment) to the oven exit 24 (or oven exit vestibule 322 in the relevant embodiment).

The conveyance mechanism 78 preferably comprises a hanging conveyance mechanism 82 generally including an conveyor 84 and a plurality of hook means 86. The conveyor 84 is located along the length of the top of the oven interior 25 and extends from oven entry 22 (or oven entry vestibule 320 in the relevant embodiment) to oven exit 24 (or oven exit vestibule 322 in the relevant embodiment). Hook means 86 are located along the length of the conveyor 84.

Figure 6:
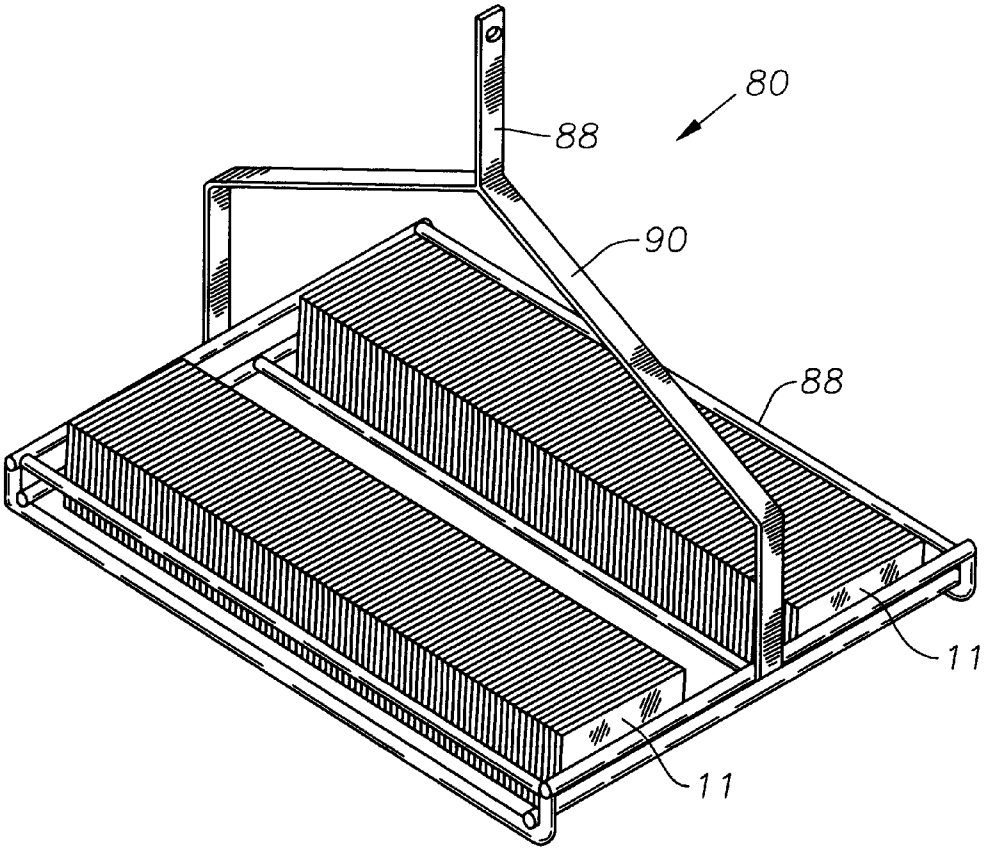
FIG. 6 is an isometric view of the evaporator fins positioned within one embodiment of the carrier mechanism.
Figure 8:
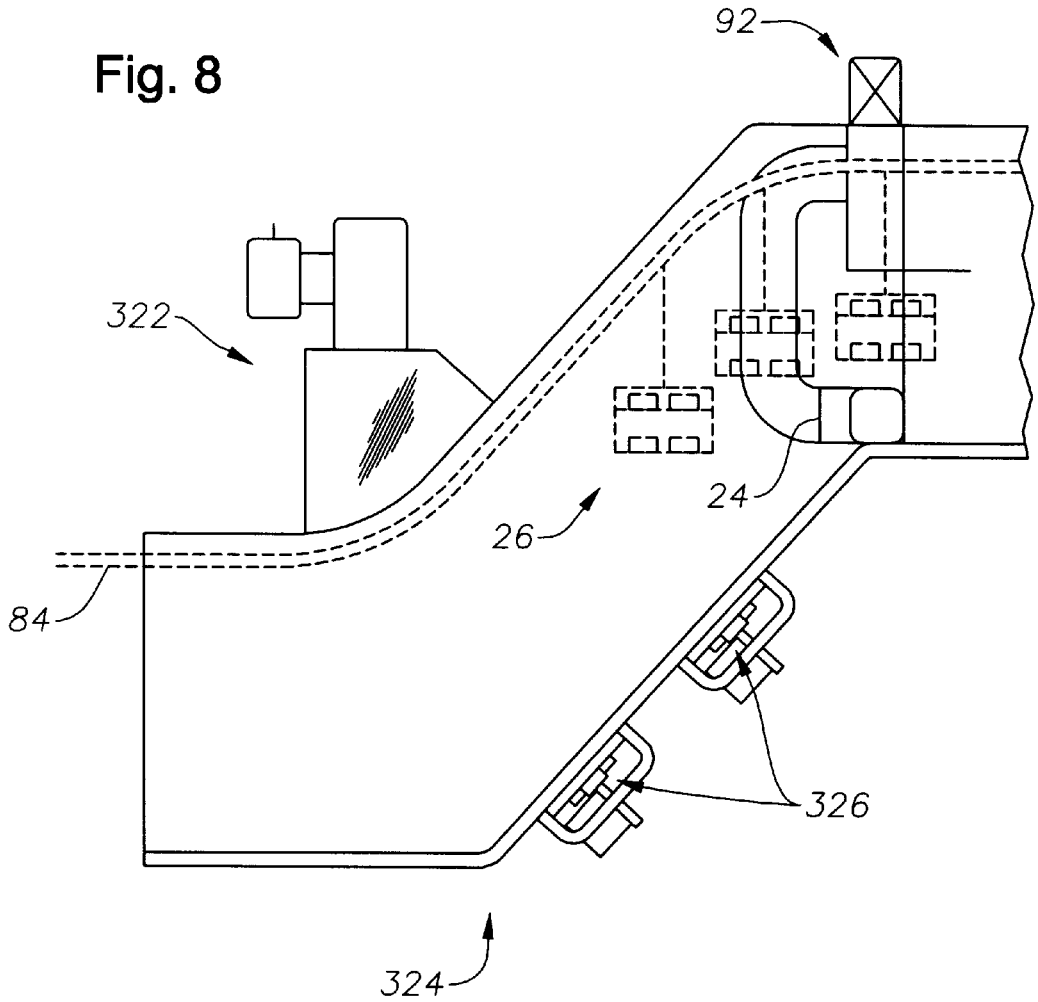
FIG. 8 is a side cross-sectional view of the oven exit vestibule including the cool-down section.

In one preferred embodiment shown in FIG. 6, carrier mechanism 80 comprises a plurality of basket structures 90, each including a basket suspension member 88, with each basket suspension member 88 connected to and projecting downward from a hook means 86. The metal components 11 are placed within the basket structure 90. Importantly, the basket structure 90, as well as any other embodiment of carrier mechanism 80, must be constructed so that it allows passage of gas therethrough from all of its sides. In a second preferred embodiment shown in FIG. 7, carrier mechanism 80 comprises a plurality of hanger structures 91, each including a hanger suspension member 89, with each hanger suspension member 89 connected to and projecting downward from a hook means 86. Also importantly, the carrier mechanism 80 as well as the hanging conveyance mechanism 82 are shaped and situated so that, as they travel within the oven interior 25, the carrier mechanism 80 is suspended within and transported through the frame formed by the plurality of plenums 48 and each basket suspension member 88 (or hanger suspension member 89) passes between the two top sections 58 of the plenum top portion 56 and the two top segment sections 70 of the low pressure duct top segment 68.

In the preferred embodiment, oven gas supply means 200 comprises an equal number of high pressure gas supply means 32 and low pressure gas supply means 34. Although they need not be, in one embodiment, the high pressure gas supply means 32 are in fluid communication with each other. Likewise, although they need not be, in one embodiment, the low pressure gas supply means 34 are in fluid communication with each other.

In one embodiment, oven 20 is comprised of a plurality of oven sections 21. Each oven section 21 is similar to oven 20, as previously described, and thus includes an oven section entry **22*b*, an oven section exit 24*b*, an oven section interior 25*b*, a section transportation mechanism 26*b*, an oven section gas supply means 28*b*, and an oven section gas exhaust means 30*b*. The oven sections 21 are arranged so that the oven exit 24*b* of one oven section 21 is directly adjacent to the oven section entry 22*b* of another oven section 21. Thus, the plurality of oven sections 21 comprise the large general shape, length, and function of oven 20. In addition, the section transportation mechanisms 26*b* of each oven section 21 are aligned, arranged, and constructed so that they function together as the longer transportation mechanism 26**.

In the embodiment including a plurality of oven sections 21, each oven section 21 preferably includes two high pressure gas supply means **32*b* and two low pressure gas supply means 34*b*. Also, it is noted that in this embodiment, the relevant parts of each oven section 21 (i.e., the high and low pressure fans, 36 and 40, and the high and low pressure gas supply conduits, 38 and 42) may be calibrated so that the temperature, low pressure flow rate, and high pressure flow rate differ in each oven section 21**.

Oxidizer 100 includes an oxidizer entry 102, an oxidizer burner 104, and an oxidizer exit 106. The oxidizer entry 102 is in fluid communication with the oven gas exhaust means 30 by way of an oven exhaust line 45. The oxidizer burner 104, located within oxidizer 100, is preferably fired by natural gas. The oxidizer exit 106 is in fluid communication with the system gas exhaust means 250.

In the preferred embodiment, system gas supply means 200 comprises at least one system gas supply fan 202, a system gas supply line 204, and a system gas supply manifold 29. The inflow side of each system gas supply fan 202 is open to the source of gas which flows through the system 10. In the preferred embodiment, the gas used by system 10 is ambient air. Thus, in this embodiment, the inflow side of each system gas supply fan 202 is open to the atmosphere and suctions ambient air. The outflow side of each system gas supply fan 204 is connected to the system gas supply line 204. The system gas supply line 204, in turn, provides fluid communication between the outflow of the system gas supply fans 204 and the system gas supply manifold 29. The system gas supply manifold 29 is then connected to and in fluid communication with the oven gas supply means 28. That is, the system gas supply manifold 29 is in fluid communication with each high pressure gas supply means 32 and each low pressure gas supply means 34 of the oven 20.

In the preferred embodiment, system gas exhaust means 250 comprises at least one system gas exhaust fan 252, a system gas exhaust line 256, and a system gas exhaust stack 254. The system gas exhaust line 256 is connected to and provides fluid communication between the oxidizer exit 106 and the inflow side of each system gas exhaust fan 252. The outflow side of each system gas exhaust fan 252 is, in turn, connected to and in fluid communication with the system gas exhaust stack 254, which itself is open to the atmosphere.

In the preferred embodiment, the system 10 includes a first heat exchanger 300 located on the system gas supply line 204. First heat exchanger 300 is also connected to, in fluid communication with, and fed by the system gas exhaust line 256. Thus, first heat exchanger 300 functions to transfer heat between the gas streams flowing within the system gas supply line 204 and the system gas exhaust line 256.

In the preferred embodiment, the system 10 includes a second heat exchanger 350 on the oven exhaust line 45. Second heat exchanger 350 is also connected to, in fluid communication with, and fed by the system gas exhaust line 256 after the system gas exhaust line 256 exits first heat exchanger 300 (downstream of the first heat exchanger 300). Thus, the second heat exchanger 350 functions to transfer heat between the gas streams flowing within the oven exhaust line 45 and the system gas exhaust line 256.

In the preferred embodiment, the system 10 also includes a system gas supply flow control means 400 to control the flow rate of gas into the oven 20. System gas supply flow control means 400 is located on system gas supply line 204. Preferably, system gas supply flow control means 400 is located on system gas supply 204 intermediate first heat exchanger 300 and oven 20.

In the preferred embodiment, system gas supply flow control means 400 comprises a system gas supply flow control line 402, a system gas supply flow control stack 404, and a system gas supply flow control valve mechanism 406. System gas supply flow control line 402 is connected to and provides fluid communication between system gas supply line 204 (downstream of the first heat exchanger 300) and system gas supply flow control stack 404. System gas supply flow control valve mechanism 406 is located on system gas supply flow control line 402 and preferably comprises a variable adjustment valve.

In this embodiment, system 10 also preferably includes a system gas supply shut-off valve mechanism 408. System gas supply shut-off valve mechanism 408 is preferably located on system gas supply line 204 downstream of the system gas supply flow control line 402. System gas supply shut-off valve mechanism 408 preferably comprises a variable adjustment valve.

In Operation

For purposes of clarity, the operation of the transportation mechanism 26 will be explained first. Initially, the metal components 11 are positioned within the carrier mechanisms 80 (basket structures 90 and/or hanger mechanisms 91 in the preferred embodiments). The placement of the metal components 11 within the carrier mechanisms 80 is important in order to take full advantage of the benefits provided by the high pressure gas supply means 32, as will be explained herein. Preferably, for those metal components 11 that are substantially smaller in one of their three dimensions and which do not include a means for hanging, such as the evaporator fins shown in FIG. 6, the metal components 11 are placed within the basket structures 90 horizontally upright, one against the other. Also preferably, for those metal components 11 that are substantially smaller in one of their three dimensions and which do include a means for hanging, such as the evaporator fins shown in FIG. 7, the metal components 11 are hung all in the same direction from the hanger structures 91, one against the other. Once the metal components 11 are correctly situated, the suspension member, 88 and 89, of each carrier mechanism 80 is hung from a hook means 86. The hanging conveyance mechanism 82 is then activated. Activation of the hanging conveyance mechanism 82 prompts the conveyor 84 to revolve thereby inducing the carrier mechanism 80 to be moved into and through the oven interior 25 from oven entry 22 to oven exit 24.

As was previously disclosed, as the carrier mechanism 80 moves within the oven interior 25, it is exposed to the gas streams flowing from the high and low pressure gas supply conduits, 38 and 42. It is understood that additional carrier mechanisms 80 are suspended from the conveyor 84 at any one time so that a number of carrier mechanisms 80 are within the oven 20 at any given time. The gas flow within system 10, together with its interaction with the transportation mechanism 26 and metal components 11 positioned therein, will now be described.

In the preferred embodiment, system gas supply fan 202 suctions air from the surrounding atmosphere at regular atmospheric temperature $T_1$ (typically approximately 70° F.) into the system gas supply line 204. The gas travels within the gas supply line 204 and through the first heat exchanger 300. Within the first heat exchanger 300, a positive heat transfer is effected on the gas travelling within the gas supply line 204 heating it from $T_1$ to $T_2$ due to its indirect contact with the gas flowing through the system gas exhaust line 256 (which is at a higher temperature, as will be disclosed herein). It is noted that $T_2$ must be a temperature which is above the vaporization point of the oil coated on the metal components 11 being transported through the oven 20 but not one which is exceedingly high thereby also preventing the thickening of the oxide layer of the metal component 11. Thus, all relevant parts of system 10 (including first heat exchanger 300) must be designed and calibrated to provide such a temperature. Preferably, $T_2$ is in the range of 400–600° F, with 800° F. being the preferable maximum allowable temperature for $T_2$.

After exiting first heat exchanger 300, the gas flows through system gas supply line 204 into the system gas supply line manifold 29 at $T_2$. Within the system gas supply manifold 29, the gas stream is picked up by the high pressure gas supply fans 36 as well as by the low pressure gas supply fans 40 of the oven gas supply means 28. Each high pressure gas supply fan 36 transmits its gas stream into and through its associated high pressure gas supply conduit 38. Likewise, each low pressure gas supply fan 40 transmits its gas stream into and through its associated low pressure gas supply conduit 42. As previously disclosed, each high pressure gas supply fan 38 transmits its associated gas stream at a relatively higher pressure and velocity than all low pressure gas supply fans 40. Also, because the high pressure and low pressure gas supply fans, 38 and 40, are variable frequency drive fans, the gas stream pressure and velocity may be altered and controlled.

The gas stream flowing through each high pressure gas supply conduit 38 first flows into the relevant high pressure duct 46. Some of the gas stream exits the high pressure duct 46 through the plurality of ports 50 located thereon. The remaining gas stream flows into the plurality of plenums 48 and exits the plenums 48 through the plurality of passages 60 located on the plenum bottom and top portions, 52 and 56 (and the longitudinal first and second pipes, 49 and 51, in the relevant embodiment). As previously disclosed, the arrival velocity of the gas passing through the plurality of ports 50 and the plurality of passages 60 is in the range of 5000–7000 ft/min.

As each carrier mechanism 80 travels through the oven interior 25, each will pass through or within the plurality of high pressure gas supply means 32. The plurality of ports 50 of the high pressure duct 46 and the plurality of passages 60 of the plenum bottom portion 52 direct the high pressure gas stream flowing therethrough towards the bottom of the carrier mechanism 80. Similarly, the plurality of passages 60 of the plenum top portion 56 (and of the longitudinal first and second pipes, 49 and 51, in the relevant embodiments) direct the high pressure gas stream flowing therethrough towards the top of the carrier mechanism 80.

As previously described, the metal components 11 are positioned within the carrier mechanism 80 horizontally upright one against the other (in the basket structures 90) or hanging in the same direction one against the other (in the hanger structures 91). Since the high pressure gas stream is directed from above and below the carrier mechanism 80 by the plurality of ports 50 and passages 60, the gas stream impinges the metal components 11 and is in effect injected between the metal components 11. Thus, the high velocity gas acts to separate the metal components 11 from each other and to provide a fluttering action to relatively light metal components 11, such as evaporator fins. The separation of the metal components 11 caused by the high pressure gas stream enables all of the surface area of the metal components 11 (even the sides thereof) to be exposed to and be cleaned by the heat of the gas streams. In addition, the high velocity impingement and the fluttering action caused thereby accelerates the evaporation rate of the oil from the metal components 11 by accelerating the rate of heat transfer to the oil and thereby reduces the residence heating time for the metal components 11. Furthermore, the high velocity impingement eliminates build-up of condensate on the metal components 11.

As previously disclosed, the two top plenum sections 58 preferably extend upwards towards each other at a 45° angle from the horizontal. Thus, the plurality of passages 60 located thereon direct their high pressure gas stream at a 45° angle downwards towards the metal components 11 positioned within the carrier mechanism 80. Concurrently, the passages 60 of the bottom plenum portion 52 and the ports 50 of the high pressure duct 46 direct their respective gas streams substantially vertically upwards towards the metal components 11 positioned within carrier mechanism 80. By providing the downward gas stream (injected by the top plenum sections 58) with a different metal component impingement angle than the upward gas stream (injected by the bottom plenum portions 52 and the high pressure duct 46), the two gas streams work together to ensure a well-developed fluttering action for the metal components 11. It is noted that if the downward and upward gas streams would oppose each other (so that their impingement angles are in effect 180° apart), then the benefit derived from including a high pressure gas supply means 32 (i.e., the fluttering action) is greatly reduced, if not altogether cancelled.

The gas stream flowing through each low pressure gas supply conduit 42 first flows into the low pressure duct 62. The gas stream flows through and exits the low pressure duct 62 through the plurality of openings 72 located throughout the bottom and top segments, 64 and 68. As each carrier mechanism 80 travels through the oven interior 25, each passes by the plurality of low pressure gas supply means 34. As previously disclosed, the plurality of openings 72 of the low pressure duct 62 direct the low pressure gas stream flowing therethrough towards the top and bottom of the carrier mechanism 80. As previously disclosed, the arrival velocity of the gas passing through the plurality of openings 72 is in the range of 1500–3000 ft/min.

Because the temperature of both the high pressure and low pressure gas streams is at $T_2$, a temperature above the vaporization point of the oil coated on the metal components 11, such oil evaporates upon contact with the gas streams. It is noted that, constituting approximately 60% of the total gas flow into oven interior 25, the low pressure gas stream is the primary heating source of the oven 20. The high pressure gas stream not only assists in the heating operation, but also serves to accelerate the evaporation process by creating the fluttering action, as previously disclosed. In turn by accelerating the evaporation process, the high pressure gas stream also serves to decrease the residence heating time for the metal components 11.

It is also noted that, because the low pressure duct 62 and the high pressure duct 46 extend substantially along the entire length of oven interior 25, because the plurality of plenums 48 are equally spaced along oven interior 25, and because gas is introduced at both the bottom and top of oven interior 25, the temperature within oven interior 25 is maintained at a substantially homogenous level. It has been observed that the temperature gradient is such to allow a deviation of +/±5° F. within oven interior 25. This deviation value is particularly pleasing and agreeable in substantially long ovens 20, such as the 96 ft oven 20 that was tested. A homogenous heating temperature, of course, allows for accurate control of the heating process and provides uniform results.

Upon vaporization, the hydrocarbon molecules of the oil are mixed into the surrounding gas thereby producing hydrocarbon-filled gas. The length of oven 20 (or the total length of oven sections 21 in the relevant embodiment), the residence heating time of the metal components 11, and the velocity of carrier mechanism 80 on conveyance mechanism 78 are such that by the time each carrier mechanism 80 reaches the oven exit 24 most, if not all, of the oil on the metal components 11 has evaporated. When each carrier mechanism 80 passes through oven exit 24, the carrier mechanism 80 next enters the oven exit vestibule 322 and is cooled by the ambient air being blown by cool air fan 326. It is noted that, because the cool air being blown is at a high velocity, the formation of condensate on the metal components 11 is minimized. At this point, the metal components 11 are cooled and have been degreased.

Figure 9:
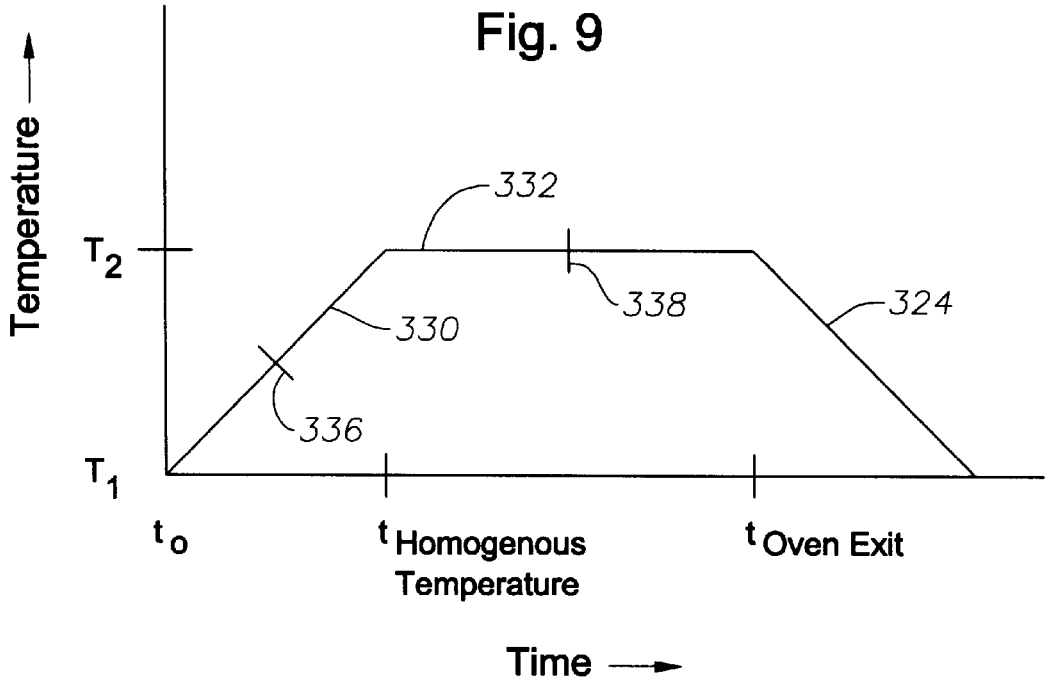
FIG. 9 is a graph plotting temperature versus time for the metal components as they proceed through the system.

FIG. 9 illustrates the temperature of the metal components 11 graphed against time as the components 11 proceed through system 10. Generally, the curve includes a ramp phase 330, a steady-state phase 332, and a cool-down phase 324. The ramp phase 330 represents the increase in temperature of the metal components 11 as they are initially inserted into the oven interior 25 from ambient temperature $T_1$ to heating temperature $T_2$. The steady-state phase 332 represents the homogenous heating temperature throughout the oven interior 25. The cool-down phase 334 represents the cooling down of the metal components 11 back to ambient temperature $T_1$ induced by the cool air fan 326 in the oven exit vestibule 322.

The evaporation of the oil, and thus the cleaning of the metal components 11, begins at a point 336, approximately halfway through the ramp phase 330, and is finished at a point 338, approximately halfway through the steady-state phase 332. The remaining portion of the steady-state phase 332 prior to the start of the cool-down phase 324 is, in effect, further means to ensure the complete cleaning of the metal components 11.

Turning back to FIGS. 1 and 5, proximate the oven exit 24, the gas stream within the oven 20, which now contains hydrocarbon molecules therein, is quickly picked up by the suction created by gas exhaust blower 44 through the gas exhaust conduits 74. The hydrocarbon-filled gas stream enters the gas exhaust conduits through the plurality of holes 76 and is then communicated into the oven exhaust line 45. It is noted that, at this post-oven stage, the temperature of the hydrocarbon-filled gas stream is at a temperature $T_3$ which is less than the temperature $T_2$. The temperature $T_3$ is lower than the temperature $T_2$ because some of the heat energy in the gas stream was, among other things, dissipated in evaporating the oil. In one embodiment, $T_3$ is in the range of 350–450° F.

The oven exhaust line 45 transports the hydrocarbon-filled gas stream from the oven 20 to the oxidizer entry 102. Within the oxidizer 100, the hydrocarbon-filled gas stream is exposed to the burner 104 which catalyzes the oxidation process. As is well known in the art, the oxidation process burns the hydrocabon-filled gas streams and transforms it into carbon dioxide and water. Thus, the oxidation process produces a hydrocarbon-less gas stream (or substantially so), which departs the oxidizer 100 through the oxidizer exit 106 and then enters system gas exhaust line 256.

After leaving the oxidizer 100 and being exposed to the burner 104 therein, the hydrocarbon-less gas stream has a temperature $T_4$, which is much higher than the temperature $T_3$. $T_4$, in the preferred embodiment, is approximately 1400° F. The hydrocarbon-less gas stream then passes through the first heat exchanger 300 where it transmits some of its heat energy to the gas stream flowing through system gas supply line 204 at the relatively lower temperature $T_1$. The difference in temperature between $T_4$ and $T_1$ causes the positive heat transfer that is effected on the gas stream flowing through system gas supply line 204 heating such gas stream from $T_1$ to $T_2$. Having dissipated some of its energy within first heat exchanger 300, the gas stream flowing within system gas exhaust line 256 exits first heat exchanger 300 at a lower temperature $T_5$. In the embodiment of system 10 which does not include a second heat exchanger 350, the hydrocarbon-less gas stream exits the system 10 via the system gas exhaust stack 254 at the temperature $T_5$.

As previously disclosed, the preferred embodiment of system 10 also includes a second heat exchanger 350 located on oven exhaust line 45 which exchanges heat between the gas stream flowing in the oven exhaust line 45 and the gas stream flowing in the system gas exhaust line 256 downstream of the first heat exchanger 300. In this embodiment, the temperature of the hydrocarbon-filled gas entering second heat exchanger 350 and flowing through oven exhaust line 45 is temperature $T_3$. The temperature of the hydrocarbon-less gas entering second heat exchanger 350 and flowing through system gas exhaust line 256 is temperature $T_5$. Even though the gas stream flowing through system gas exhaust line 256 dissipated some heat energy within first heat exchanger 300, the burner 104 of oxidizer 100 raises the temperature in such gas stream to such an extreme that the temperature $T_5$ is still substantially higher than the temperature $T_3$ (of the gas stream flowing within oven exhaust line 45). Thus, within second heat exchanger 350, the gas stream flowing through the system gas exhaust line 256 at the temperature $T_5$ transmits some of its heat energy to the gas stream flowing through the oven exhaust line 45 at the relatively lower temperature $T_3$. Having dissipated some more of its energy within second heat exchanger 350, the gas stream flowing within system gas exhaust line 256 exits second heat exchanger 350 at the still lower temperature $T_6$. In this embodiment of system 10, the hydrocarbon-less gas stream exits the system 10 via the system gas exhaust stack 254 at the temperature $T_6$. In the preferred embodiment, $T_6$ is in the range of 400–500° F.

The transfer of heat within the second heat exchanger 350 also raises the temperature of the hydrocarbon-filled gas stream flowing through oven exhaust line 45 from a temperature of $T_3$ to a temperature of $T_7$. Thus, in this embodiment, the hydrocarbon-filled gas stream flowing through oven exhaust line 45 enters the oxidizer 100 at the temperature $T_7$, a temperature which is relatively higher than the temperature $T_3$ used as an oxidizer input temperature in the embodiment not including second heat exchanger 350. The relatively higher oxidizer input temperature $T_7$ enables the burner 104 of oxidizer 100 to utilize less energy (relative to temperature $T_3$) to raise the temperature of the relevant gas stream up to the temperature necessary to catalyze the oxidation process and up to $T_4$, the input temperature of the first heat exchanger 300. Thus, in practical terms, second heat exchanger 350 allows for the conservation of energy in system 10. In the preferred embodiment, $T_7$ is in the range of 550–650° F.

The preferred embodiment of the system 10 also includes a system gas supply flow control means 400 which controls the flow rate of gas into the oven 20. The system gas supply flow control means 400 generally comprises a system gas supply flow control line 402, a system gas supply flow control stack 404, and a system gas supply flow control valve mechanism 406. During the operation of system 10, the operator may find it useful or necessary to decrease or restrict the flow of the gas stream within the system gas supply line 204. For example, an operator may undertake to manipulate such gas stream flow in order to control the conditions (including temperature and pressure) of the gas within the oven interior 25. By completely closing the system gas supply flow control valve mechanism 406, the operator enables all of the gas stream circulated by the system gas supply fan 202 to enter into the oven 20 and continue through the system 10. If the operator wishes to decrease the flow rate of the gas stream circulated by the system gas supply fan 202 into the oven 20, then the operator partially or completely opens the system gas supply flow control valve mechanism 406 thereby diverting some of the gas stream to flow through the system gas supply flow control line 402 and exit the system 10 through the system gas supply flow control stack 404. If the operator wishes to completely restrict the access of the gas stream circulated by the gas supply fan 202 into the oven 20, then the operator completely closes system gas supply shut-off valve mechanism 408 and at least partially opens system gas supply flow control valve mechanism 406 thereby diverting all of the gas stream to flow through the system gas supply flow control line 402 and exit the system 10 through the system gas supply flow control stack 404. It is also understood that, in conjunction with the system gas supply flow control valve mechanism 406 as disclosed herein, the operator may also utilize the system gas supply shut-off valve mechanism 408 to regulate the volume flow rate of the gas stream circulated by the system gas supply fan 202 into the oven 20.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A method for removing oil and grease from metal components, comprising:

providing said metal components with said oil and grease coated thereon;

providing a burnerless oven having an oven interior;

supplying said oven with a gas supply;

heating said gas supply to a temperature above the vapor points of said oil and grease;

exposing said metal components to said heated gas supply by injecting said heated gas supply into said oven interior by at least one high velocity first heated gas stream and at least one low velocity second heated gas stream, whereby said oil and grease evaporate upon contact with said heated gas streams;

evacuating said vaporized oil and grease from said oven interior; and oxidizing said vaporized oil and grease subsequent to it being evaporated from said oven interior thereby producing environmentally safe exhaust gas.

2. A method as claimed in claim 1, further comprising providing a transportation mechanism that transports said metal components through said oven interior thereby exposing said metal components to said first and second heated gas streams.

3. A method as claimed in claim 2, further comprising:

positioning a first source of each said first heated gas stream so that said first source frames said metal components as said metal components are transported through said oven interior by said transportation mechanism; and positioning a second source of each said second heated gas stream so that said second source frames said first source.

4. A method as claimed in claim 3, further comprising directing each said first and second heated gas streams to a top and a bottom of said metal components.

5. A method as claimed in claim 1, further comprising controlling a flow rate of said heated gas supply into said oven interior.

6. A method as claimed in claim 1, further comprising:

removing said metal components from said oven interior once said oil and grease have evaporated therefrom; and cooling said metal components after said removing step.

7. A method as claimed in claim 6, wherein said cooling step comprising blowing ambient air at ambient temperature at said metal components.

8. A method as claimed in claim 1, wherein said heating step comprising effecting a first positive heat transfer from said exhaust gas to said gas supply prior to said gas supply entering said oven thereby heating said gas supply to a temperature above the vapor points of said oil and grease.

9. A method as claimed in claim 8, further comprising effecting a second positive heat transfer from said exhaust gas downstream of said first positive heat transfer to said vaporized oil and grease prior to said vaporized oil and grease being oxidized in said oxidation step.

10. A method as claimed in claim 1, further comprising regulating at least a portion of the supply of said heated gas to induce a fluttering action in said metal components.

* * * * *